US006772537B2

(12) United States Patent
Kawahara

(10) Patent No.: US 6,772,537 B2
(45) Date of Patent: Aug. 10, 2004

(54) PRESSURE-HEAT DRYING METHOD AND AN APPARATUS THEREFOR

(75) Inventor: Masaru Kawahara, Saitama (JP)

(73) Assignee: Koy Engineering Corporation, Saitama-ken (JP)

( * ) Notice: Subject to any disclaimer, the term of this patent is extended or adjusted under 35 U.S.C. 154(b) by 0 days.

(21) Appl. No.: 10/354,082

(22) Filed: Jan. 30, 2003

(65) Prior Publication Data

US 2004/0060194 A1 Apr. 1, 2004

(30) Foreign Application Priority Data

Feb. 1, 2002 (JP) ..... 2002-25164

(51) Int. Cl.[7] ..... F26B 5/04

(52) U.S. Cl. ..... 34/405; 34/402; 34/413; 34/497

(58) Field of Search ..... 34/402, 405, 413, 34/468, 471, 476, 486, 497

(56) References Cited

U.S. PATENT DOCUMENTS

| | | | | |
|---|---|---|---|---|
| 4,560,346 A | * | 12/1985 | Schulz | 432/24 |
| 4,667,522 A | | 5/1987 | Kawahara | |
| 5,368,649 A | | 11/1994 | Tsukazaki | |
| 5,404,654 A | * | 4/1995 | Babinsky et al. | 34/122 |
| 5,473,826 A | * | 12/1995 | Kirkbir et al. | 34/405 |
| 5,576,415 A | | 11/1996 | Tanaka | |
| 5,598,642 A | | 2/1997 | Orloff et al. | |
| 5,953,828 A | * | 9/1999 | Hillman | 34/74 |
| 6,014,819 A | * | 1/2000 | Elder | 34/396 |
| 6,640,462 B1 | * | 11/2003 | Choi et al. | 34/406 |

FOREIGN PATENT DOCUMENTS

| | | |
|---|---|---|
| JP | 64-5075 | 1/1989 |
| JP | 5-10596 | 1/1993 |
| JP | 8-977 | 1/1996 |
| JP | 2000-292056 | 10/2000 |

* cited by examiner

*Primary Examiner*—Ira S. Lazarus
*Assistant Examiner*—Kathryn S. O'Malley
(74) *Attorney, Agent, or Firm*—Wenderoth, Lind & Ponack, L.L.P.

(57) ABSTRACT

An object of the present invention is to provide a pressure-heat drying method which allows a catalytic substance and the like to be deposited uniformly onto a workpiece to be dried in a dramatically short time as compared to a prior art method, and also an apparatus therefor. The present invention provides a pressure-heat drying method for drying a workpiece to be dried in a pressure vessel, said workpiece coated with a solution containing a solute dissolved in a solvent adhering thereto, said method comprising: a pressure increase process for increasing a pressure in said pressure vessel to a set pressure higher than a saturated vapor pressure of said solvent at a set temperature; a temperature increase process for increasing a temperature in said pressure vessel to said set temperature under a condition where an evaporation of said solvent is suppressed with the aid of said set pressure which has been achieved through said pressure increase process; a pressure and temperature maintenance process for maintaining said set pressure and said set temperature in said pressure vessel at constant levels, respectively; and a pressure reduction and deposition process for reducing said set pressure to a level lower than the saturated vapor pressure at said set temperature and thereby stimulating a rapid evaporation of said solvent so as to allow said solute to be uniformly deposited onto said workpiece.

6 Claims, 8 Drawing Sheets

PRESSURE-HEAT DRYING METHOD AND AN APPARATUS THEREFOR

BACKGROUND OF THE INVENTION

The present invention relates to a pressure-heat drying method for controlling a drying process such that catalyst and the like may be uniformly deposited onto a workpiece made of porous material, such as ceramics, or metallic material, and also to an apparatus therefor.

When a workpiece to be dried, which has been coated with a solution containing catalytic substance dissolved in a solvent adhering thereto, is subjected to heat drying under atmospheric pressure, a temperature distribution within a vessel for accommodating the workpiece and applying the heat drying thereto may vary depending on locations therein and whereby the solvent adhering onto a surface of the workpiece does not evaporate uniformly, resulting in uneven deposition of the residual catalytic substance onto the surface of the workpiece having been subjected to the dry processing.

In order to cope with the above problem, there has been employed a conventional method in which a workpiece to be dried, which has been coated with a solution containing catalytic substance dissolved in solvent adhering thereto, is once subjected to an instantaneous freezing treatment to stop a movement of the catalytic substance (e.g., ions) and then the solvent is sublimated from the solution uniformly adhering to a surface of the workpiece in a solid state so as to dry the workpiece.

The above-mentioned freeze-drying method may be practiced by using, for example, a freeze-drying apparatus 50 shown in FIG. 8. To explain this method more specifically, a workpiece 60 with said solution adhering thereto is made frozen instantaneously by using liquid nitrogen or the like and brought into a vessel 51. Then, the vessel 51 is evacuated to vacuum (in the range of 10 Pa) by a vacuum pump 53 and the temperature in the vessel 51 is controlled so that it is not higher than a fusing point of the solvent (e.g., not greater than the fusing point of 0° C. for a water used as the solvent) by a heater 52, so that the solvent adhering to the workpiece 60 to be dried may be sublimated.

However, said freeze-drying treatment is problematic in that the drying process could only take place moderately because of said treatment depending on the sublimation of the solvent adhering to the workpiece. This may lead to a problem whereby the completion of the drying process would take a considerably long period, a total of about one week. Besides, since the freeze-drying apparatus used therefor requires refrigeration facilities, vacuum evacuation facilities and so on in addition to the heating facilities, the entire unit of equipment must be large in scale and inevitably increase a cost thereof.

The present invention has been made in the light of the above-pointed problems, and an object thereof is to provide a pressure-heat drying method which allows a catalytic substance and so on to be uniformly deposited onto a workpiece to be dried in a dramatically short time period as compared to the prior art method and also a pressure-heat drying apparatus therefor.

SUMMARY OF THE INVENTION

The present invention provides a pressure-heat drying method for drying a workpiece to be dried in a pressure vessel, said workpiece coated with a solution containing a solute dissolved in a solvent adhering thereto, said method characterized in comprising: a pressure increase process for increasing a pressure in said pressure vessel to a set pressure higher than a saturated vapor pressure of said solvent at a set temperature; a temperature increase process for increasing a temperature in said pressure vessel to said set temperature under a condition where an evaporation of said solvent is suppressed with the aid of said set pressure which has been achieved through said pressure increase process; a pressure and temperature maintenance process for maintaining said set pressure and said set temperature in said pressure vessel at constant levels, respectively; and a pressure reduction and deposition process for reducing said set pressure to a level lower than the saturated vapor pressure at said set temperature and thereby stimulating a rapid evaporation of said solvent so as to allow said solute to be uniformly deposited onto said workpiece.

Further, an amount of evaporation of said solvent may be controlled by controlling a pressure reduction rate in said pressure reduction and deposition process.

The present invention further provides a pressure-heat drying method for drying a workpiece to be dried in a pressure vessel, said workpiece coated with a solution containing a solute dissolved in a solvent adhering thereto, said method characterized in comprising: a pressure increase process for increasing a pressure in said pressure vessel to a set pressure higher than a saturated vapor pressure of said solvent at a set temperature; a temperature increase, condensation and deposition process for increasing a temperature in said pressure vessel to said set temperature and thereby evaporating a certain amount of said solvent induced by a differential pressure between a saturated vapor pressure at a temperature of a cooling section in said pressure vessel and said set pressure in said pressure vessel to form a condensation thereof in said cooling section so as to allow said solute to be uniformly deposited onto said workpiece; a pressure and temperature maintenance process for maintaining said set pressure and said set temperature in said pressure vessel at constant levels, respectively; and a pressure reduction process for reducing said set pressure.

Further, an amount of said solvent to form the condensation in said cooling section may be controlled by controlling a temperature increase rate in said temperature increase, condensation and deposition process.

The present invention further provides a pressure-heat drying method for drying a workpiece to be dried in a pressure vessel, said workpiece coated with a solution containing a solute dissolved in a solvent adhering thereto, said method characterized in comprising: a pressure increase process for increasing a pressure in said pressure vessel to a set pressure lower than a saturated vapor pressure of said solvent at a set temperature; a temperature increase, evaporation and deposition process for increasing a temperature in said pressure vessel to said set temperature and thereby evaporating a certain amount of said solvent induced by a differential pressure between a saturated vapor pressure in said pressure vessel and said set pressure in said pressure vessel so as to allow said solute to be uniformly deposited onto said workpiece; a pressure and temperature maintenance process for maintaining said set pressure and said set temperature in said pressure vessel at constant levels, respectively; and a pressure reduction process for reducing said set pressure.

Further, an amount of evaporation of said solvent may be controlled by controlling a temperature increase rate in said temperature increase, evaporation and deposition process.

The present invention further provides a pressure-heat drying apparatus comprising: a pressure vessel for accommodating a workpiece to be dried, said workpiece coated with a solution containing a solute dissolved in a solvent adhering thereto; a pressure regulating means for increasing a pressure in said pressure vessel to a level equal to or higher than an atmospheric pressure by introducing an air or an inert gas into said pressure vessel; a temperature regulating means for increasing a temperature in said pressure vessel to a level equal to or higher than a room temperature; a pressure and temperature maintaining means for maintaining the pressure and the temperature in said pressure vessel constantly at a set pressure and a set temperature, respectively; and a pressure reducing means for reducing the pressure in said pressure vessel to the atmospheric pressure.

Alternatively, said pressure vessel may further comprise a cooling section and a temperature in the cooling section may be controlled to be equal or lower than said set temperature. Still alternatively, said pressure vessel may further comprise a circulation means for efficiently controlling the temperature in said pressure vessel. Yet still alternatively, said pressure vessel may accommodate a plurality of said workpieces.

DETAILED DESCRIPTION OF THE INVENTION

Figure 1:
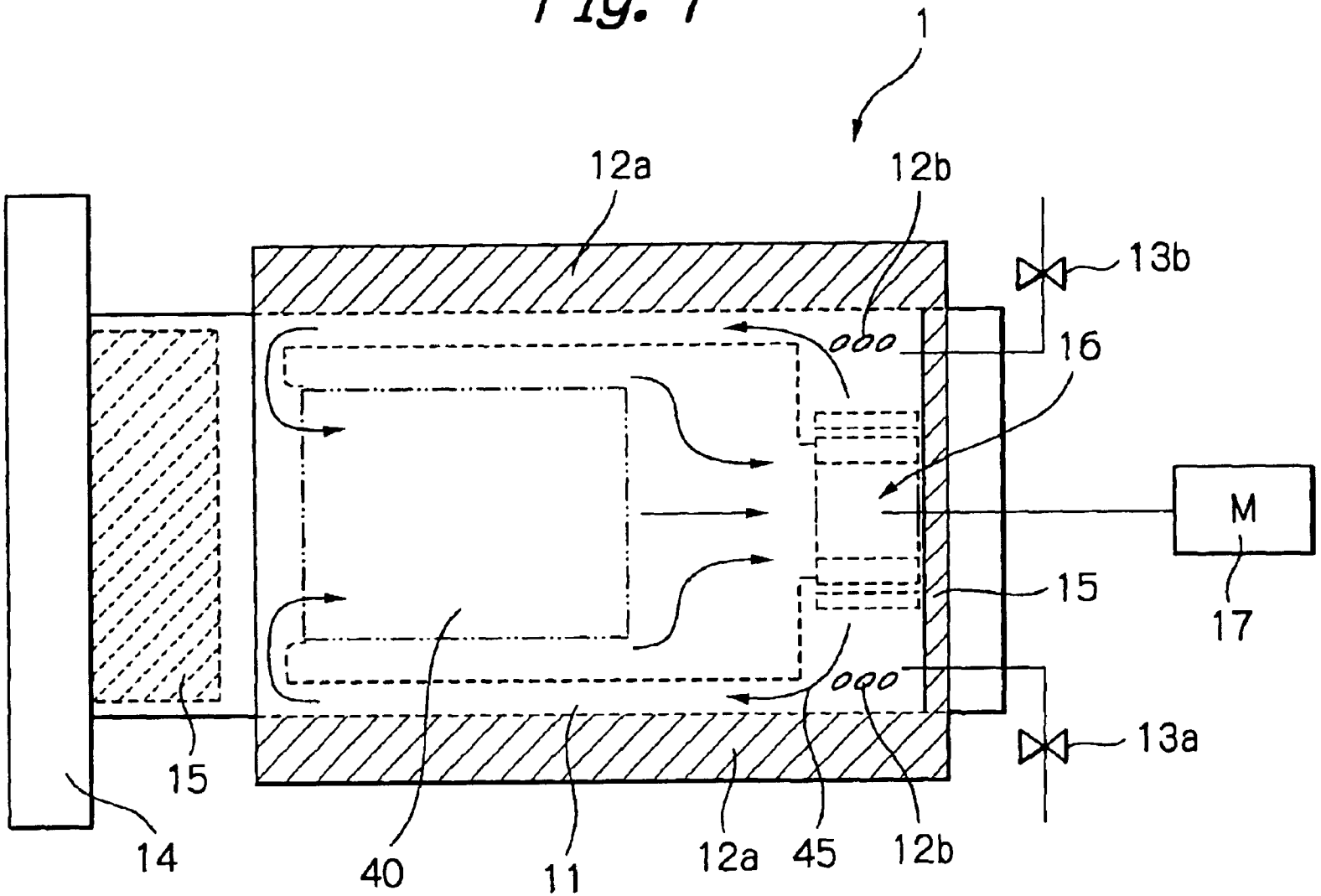
FIG. 1 is a simplified cross-sectional view representing an embodiment of a pressure-heat drying apparatus according to the present invention.

Preferred embodiments of a pressure-heat drying method and a pressure-heat drying apparatus according to the present invention will now be described with reference to the attached drawings. FIG. 1 shows a pressure-heat drying apparatus 1 according to the present invention. As shown in FIG. 1, this pressure-heat drying apparatus 1 comprises as main components thereof: a pressure vessel 11 for accommodating such a workpiece 40 to be dried that is coated with a solution containing a solute dissolved in a solvent adhering thereto; a pressure regulating means for increasing a pressure in the pressure vessel 11 to a pressure level equal to or higher than an atmospheric pressure by introducing, for example, an air or an inert gas into the pressure vessel 11; a temperature regulating means for increasing a temperature in the pressure vessel 11 to a temperature level equal to or higher than a room temperature; a pressure and temperature maintaining means for maintaining the pressure and the temperature in the pressure vessel constantly at a set pressure and a set temperature, respectively; and a pressure reducing means for reducing the pressure in the pressure vessel 11 to the atmospheric pressure.

The above-mentioned pressure vessel 11 is an approximately cylindrical shaped vessel extending in the lateral direction in FIG. 1 and the pressure vessel 11 is situated in a central location of the apparatus 1. The pressure vessel 11 is open in one end (the left hand side in FIG. 1), through which a workpiece 40 to be dried may be introduced into the pressure vessel 11 to be accommodated therein. A vessel lid 14 is provided in said one end of the pressure vessel 11, which may block the one end of the pressure vessel 11 to bring the pressure vessel 11 in a sealingly closed state. Further, both end faces of the pressure vessel 11, i.e., an inner face of the vessel lid 14 and a surface defined in the other end of the pressure vessel 11 (i.e., the right hand side inner face in FIG. 1) are provided with heat insulators 15, respectively.

Above-mentioned pressure regulating means is constituted of a pressure gas introduction valve 13*a* for increasing a pressure in the pressure vessel 11 and a gas exhaust valve 13*b* for reducing the pressure in the pressure vessel 11. An air or an inert gas may be supplied from a compressor or a high-pressure steel cylinder into the pressure vessel 11 through this pressure gas introduction valve 13*a*.

Above-mentioned temperature regulating means is constituted of an external heater 12*a* arranged in an outer periphery of the pressure vessel 11 and an internal heater 12*b* disposed within the pressure vessel 11. Further, a fan 16 is also disposed in the pressure vessel 11, which functions as a circulation means for efficiently controlling the temperature in the pressure vessel 11. This fan 16 is rotationally driven by a motor 17, and this rotational driving of the fan 16 may produce an air flow 45 within the pressure vessel 11, which helps the temperature in the pressure vessel 11 to be controlled efficiently by the external heater 12*a* and the internal heater 12*b*.

Above-mentioned pressure and temperature maintaining means functions to maintain the pressure and the temperature in the pressure vessel 11 constantly at the set pressure and the set temperature, respectively, as described above, and is constituted mainly of the pressure gas introduction valve 13*a* and the gas exhaust valve 13*b* together forming said pressure regulating means, the external heater 12*a* and the internal heater 12*b* together forming said temperature regulating means, and a control means which is not shown but controls the pressure gas introduction valve 13*a*, the gas exhaust valve 13*b*, the external heater 12*a* and the internal heater 12*b*. This control means is constituted of a pressure control section for controlling the pressure gas introduction valve 13*a* and the gas exhaust valve 13*b* and a temperature control section for controlling the external heater 12*a* and the internal heater 12*b*.

The above-mentioned pressure reducing means functions to reduce the pressure in the pressure vessel 11 to the atmospheric pressure, and may be made up of said gas exhaust valve 13*b*.

Figure 2:
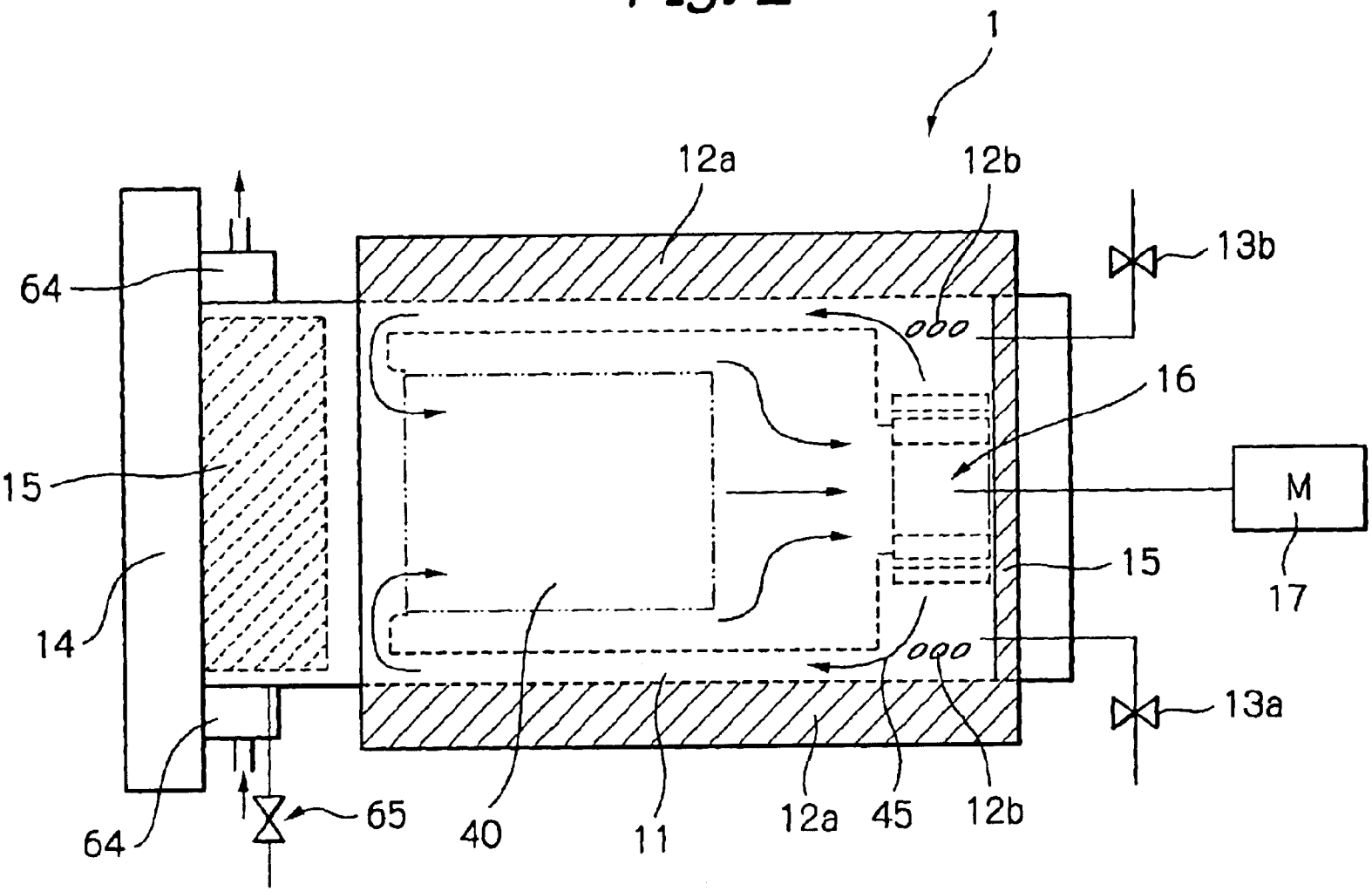
FIG. 2 is a simplified cross-sectional view representing another embodiment of a pressure-heat drying apparatus according to the present invention.

The pressure-heat drying apparatus 1 shown in FIG. 1 represents the one of the types, which includes no cooling section, while FIG. 2 shows a pressure-heat drying apparatus 1 of the other type equipped with the cooling section. The cooling section is, as shown in FIG. 2, arranged in an inner face of the vessel lid 14 and constituted mainly of a water cooling jacket 64 and a drain valve 65. This cooling section functions such that, as will be described later, the evaporated solvent may be condensed by the water cooling jacket and thus condensed solvent may be discharged through the drain valve 65. It is a matter of course that the temperature in this cooling section is set to be lower than said set temperature. This means that in the pressure vessel 11, the temperature in the vicinity of the cooling section is lower than the temperature in the other regions within the pressure vessel 11.

As described above, the above-mentioned workpiece 40 to be dried is coated with the solution containing the solute dissolved in the solvent adhering thereto, and in one example, if the solute is copper sulfate prepared as a catalytic substance, an aqueous solution of copper sulfate containing the copper sulfate (the catalytic substance) dissolved in the water may be used to adhere to and thus coat therewith the workpiece 40. In one exemplary method for adhering and coating, the workpiece 40 may be dipped in the aqueous solution of copper sulfate so that the aqueous solution of copper sulfate may adhere to the workpiece 40 so as to coat the entire surface thereof. Further, as to the workpiece 40, a metallic material may be used, including, for example, ceramics in the form of a circular cylinder having a honeycomb shaped surface.

Although in the examples shown in FIG. 1 and FIG. 2, only one workpiece 40 to be dried is accommodated in the pressure vessel 11, a plurality of workpieces 40 to be dried can be accommodated in this pressure vessel 11. For example, a plurality of workpieces 40 aligned in a straight line or in a radial pattern may be accommodated.

Figure 3:
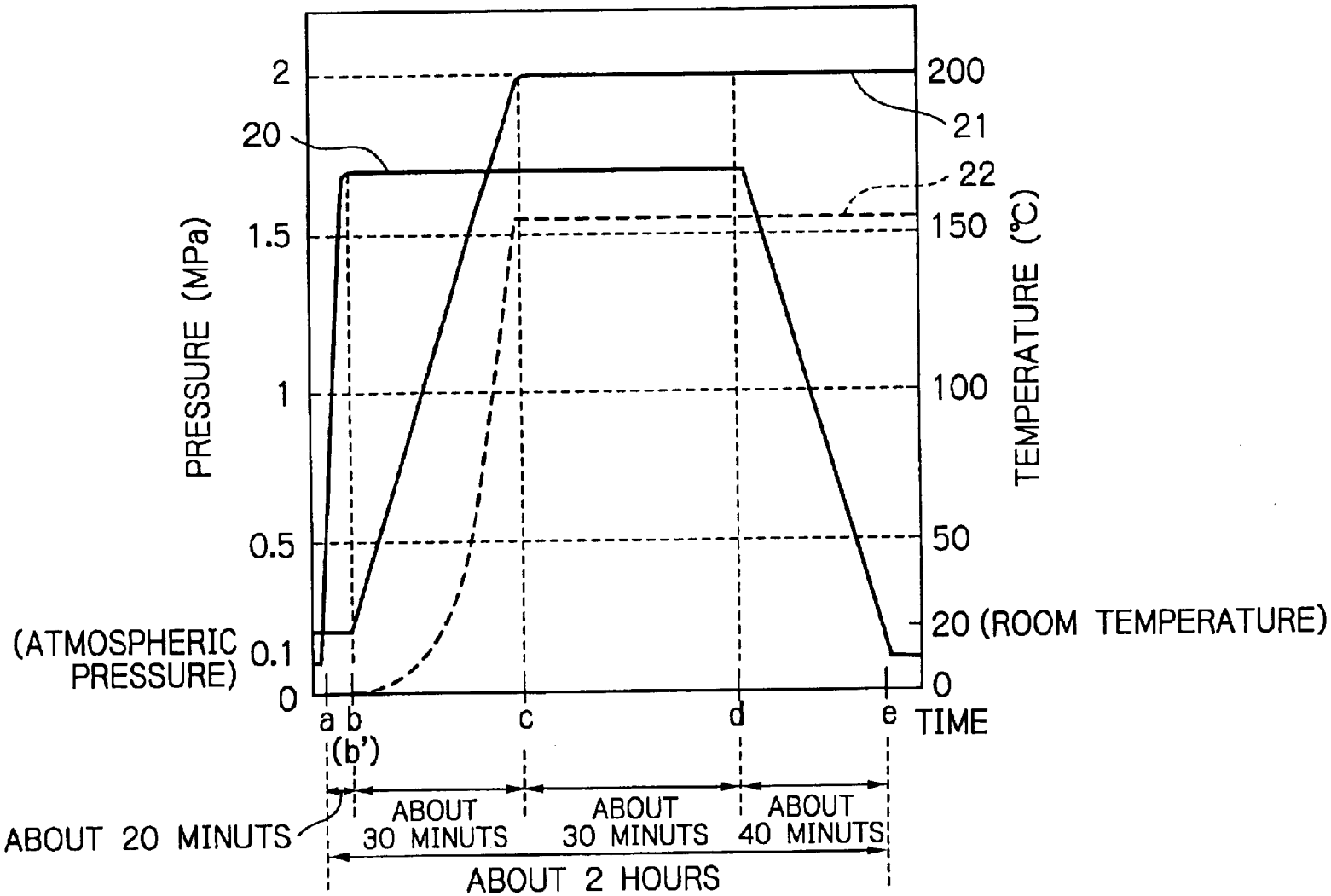
FIG. 3 is a graph representing one example of a drying mode in a pressure-heat drying apparatus according to the present invention.
Figure 4:
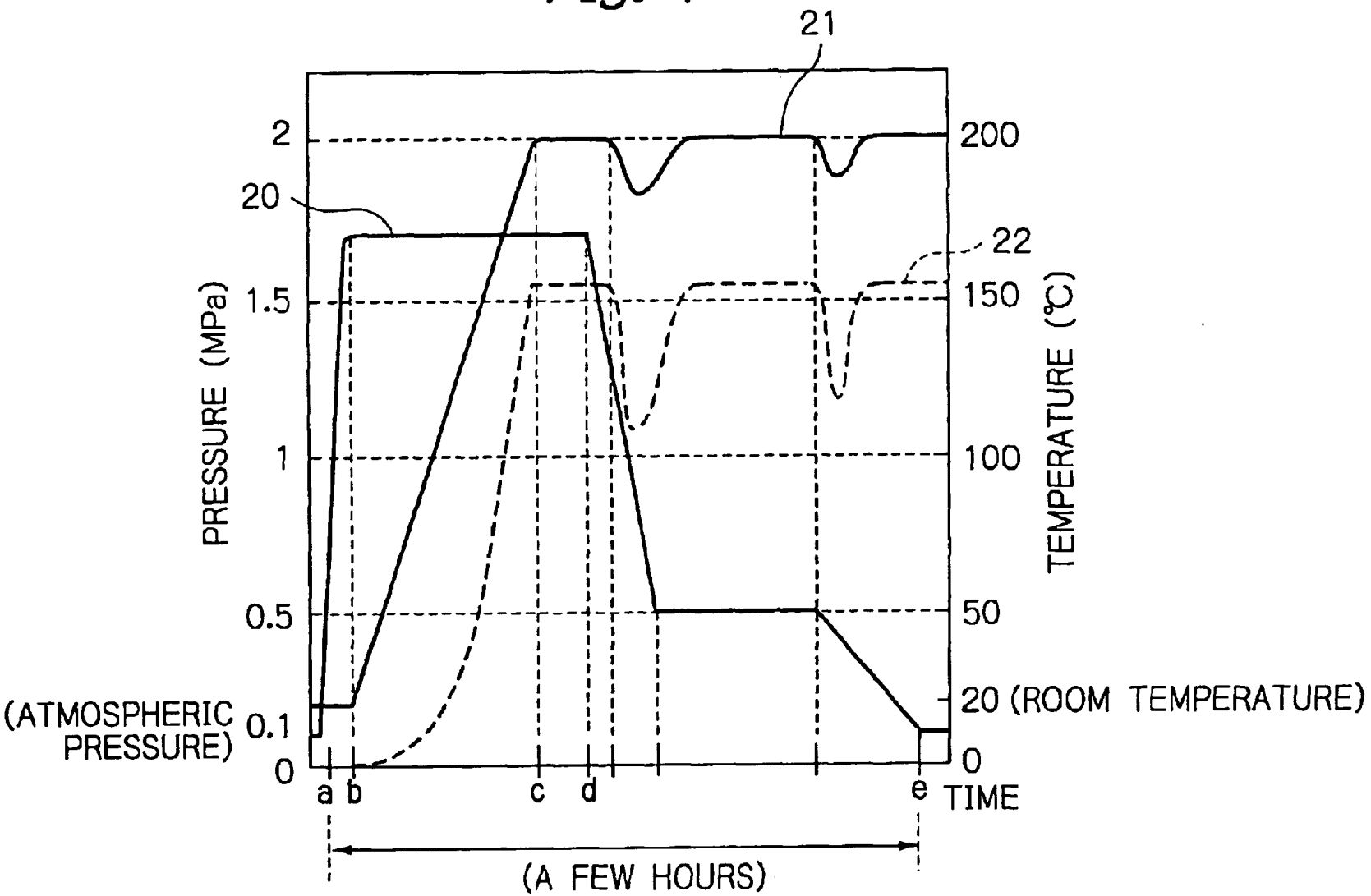
FIG. 4 is a graph representing another example of a drying mode in a pressure-heat drying apparatus according to the present invention.
Figure 5:
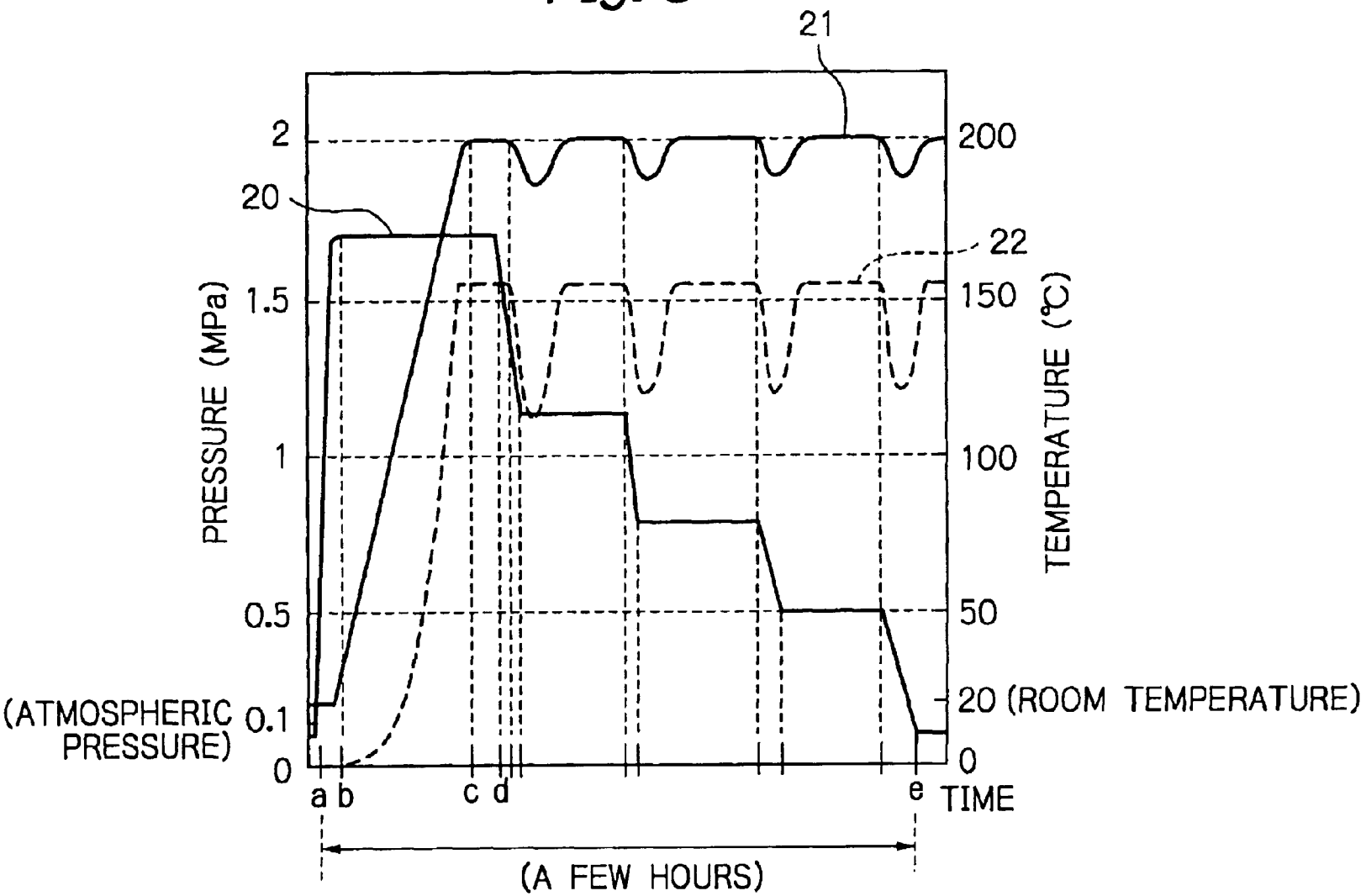
FIG. 5 is a graph representing still another example of a drying mode in a pressure-heat drying apparatus according to the present invention.

Then, a pressure-heat drying method for a workpiece 40 to be dried in the above-mentioned pressure-heat drying apparatus 1 of the type equipped with no cooling section, which is shown in FIG. 1 and represents one of the features of the present invention, will be described with reference to the graphs shown in FIG. 3 to FIG. 5. It is to be appreciated that those graphs shown in FIG. 3 to FIG. 5 show a case where the circular cylindrical ceramics having the honeycomb shaped outer surface with the aqueous solution of copper sulfate adhering thereto is employed as the workpiece 40. As can be seen from the graphs shown in FIG. 3 to FIG. 5, pressure values (unit: MPa) and temperature values (unit: ° C.) are indicated along respective vertical lines and elapsed time is indicated along a horizontal line. In each graph, a solid line designated by reference numeral 20 indicates a pressure within the pressure vessel 11, a solid line designated by reference numeral 21 indicates a temperature within the pressure vessel 11, and a broken line designated by reference numeral 22 indicates a saturated vapor pressure of the water in the aqueous solution of copper sulfate at the temperature in the pressure vessel, each shown as a function of the time.

As shown in FIG. 1, the workpiece 40 (ceramics with the aqueous solution of copper sulfate adhering thereto over an entire surface thereof) is accommodated within the pressure vessel 11 of the pressure-heat drying apparatus 1 and then the pressure vessel 11 is sealingly closed by the vessel lid 14. Subsequently, as shown in FIG. 3, the air is supplied from the compressor into the pressure vessel 11 through the pressure gas introduction valve 13*a* of the pressure regulating means so as to increase a pressure 20 in the pressure vessel 11 from a level of about 0.1 MPa (an atmospheric pressure) to a set pressure higher than a saturated vapor pressure 22 of the water at a set temperature (the pressure increase process). This set pressure may be set to be any values within the range of 0.5–5.0 MPa, and in specific, since in the case shown in FIG. 3, the set temperature is 200° C., the set pressure is specified to be about 1.7 MPa, which is higher than the saturated vapor pressure of the water at said set temperature (about 1.6 MPa). Besides, a time period from a starting point "a" of pressure increase to a goal point "b" up to a set pressure (i.e., a pressure increase process time) is set to be about 20 minutes.

Then, under the condition where the evaporation of the water is suppressed with the aid of the set pressure (about 1.7 MPa) which has been achieved in the pressure increase process, the temperature 21 in the pressure vessel 11 is increased from a level of about 20° C. (the room temperature) to the set temperature of 200° C. by activating the external heater 12*a* together with the internal heater 12*b* of the temperature regulating means (the temperature increase process). During this temperature increase process, the fan 16 is rotationally driven so as to generate an air flow 45 in the pressure vessel, which can help the temperature in the pressure vessel 11 to be efficiently regulated by the external heater 12*a* and the internal heater 12*b*. In addition, since the evaporation of the water is being suppressed under the pressure (the set pressure) higher than the saturated vapor pressure of the water at the set temperature of 200° C., thermal energy may be supplied to the workpiece 40 but the evaporation of the water (solvent) occurs very little as the theory shows. This set temperature may be set to be equal to or higher than 100° C. and the set temperature represented in FIG. 3 has been set to be about 200° C. The set temperature may vary in accordance with properties and/or dimensions and so on of the workpiece 40. Besides, a time period from a starting point "b'" of temperature increase to a goal point "c" up to the set temperature (a temperature increase process time) is specified to be about 30 minutes.

Then, the above-described pressure and temperature maintaining means is now activated to maintain the set pressure and the set temperature in the pressure vessel 11 at constant levels, respectively (the pressure and temperature maintenance process). It is to be noted that a time period between the goal point "c" up to the set temperature and a starting point "d" of pressure reduction (a pressure and temperature maintenance process time) is specified to be about 30 minutes.

Subsequently, the air and the water vapor in the pressure vessel are exhausted by actuating the gas exhaust valve 13*b* serving as the pressure reducing means so as to reduce the set pressure down to a pressure level lower than the saturated vapor pressure at the set temperature and thereby to stimulate a rapid evaporation of the water (solvent), leaving the copper sulfate (solute) deposited uniformly onto the workpiece 40 (the pressure reduction and deposition process). When the pressure in the pressure vessel 11 is reduced to be lower than the saturated vapor pressure at the set temperature of 200° C., the evaporation of the water, which has been suppressed under the set pressure, may be triggered at a burst by using said thermal energy having been supplied to the workpiece 40 and thereby the copper sulfate is forced to be deposited uniformly onto the workpiece 40. In this regard, the amount of water evaporation per unit time period can be controlled by controlling a pressure reduction rate in this pressure reduction and deposition process.

As the pressure is lowered, also the temperature 21 in the pressure vessel 11 and associatively the saturated vapor pressure 22 tend to be lowered, but said pressure and temperature maintaining means controls the temperature 21 and the saturated vapor pressure 22 to be maintained at the set values, respectively. In the example shown in FIG. 3, the pressure 20 in the pressure vessel 11 has been reduced from the level of about 1.7 MPa (the set pressure) to the level of about 0.1 MPa (the atmospheric pressure). In this process, a time period from a starting point "d" of pressure reduction to a goal point "e" of pressure reduction (the pressure reduction and deposition process) is specified to be about 40 minutes. After completing the above-described pressure reduction and deposition process, it is confirmed that the pressure in the pressure vessel 11 has been dropped to the atmospheric pressure, and the workpiece 40 now with the copper sulfate deposited thereon uniformly is cooled and then taken out of the pressure vessel 11.

According to the above-discussed pressure-heat drying method, since the workpiece 40, which has been coated with the aqueous solution of copper sulfate adhering to the surface thereof, can be dried within about 120 minutes, the workpiece 40 can be dried in a dramatically shorter time period as compared to the prior art method.

In the example shown in FIG. 3, although the pressure 20 in the pressure vessel 11 has been rapidly reduced at a stroke from the level of about 1.7 MPa (the set pressure) to the level of about 0.1 MPa (the atmospheric pressure), the pressure may not be necessarily reduced at a stroke. If the pressure 20 in the pressure vessel 11 is rapidly reduced at a stroke, the workpiece 40 could be occasionally broken in dependence on the strength, the critical temperature for heat resistance and/or the shape of the workpiece 40, and so, in such a case, the pressure would not be reduced at a stroke but, for example, the pressure may be reduced step by step. That is, said evaporation should take place gradually and separately a plurality of times.

FIG. 4 shows a graph representing a case, in which the pressure 20 in the pressure vessel 11 has been reduced in two steps with one additional landing step interposed between the starting point "d" of pressure reduction and the goal point "e" of pressure reduction. Further, FIG. 5 shows a graph representing another case, in which the pressure 20 in the pressure vessel 11 has been reduced in a plurality of steps from the starting point "d" of pressure reduction to the goal point "e" of pressure reduction. It is to be noted that in both cases shown in FIG. 4 and FIG. 5, the workpiece 40 with the aqueous solution of copper sulfate adhering to the entire surface thereof can be dried in a few hours.

Figure 6:
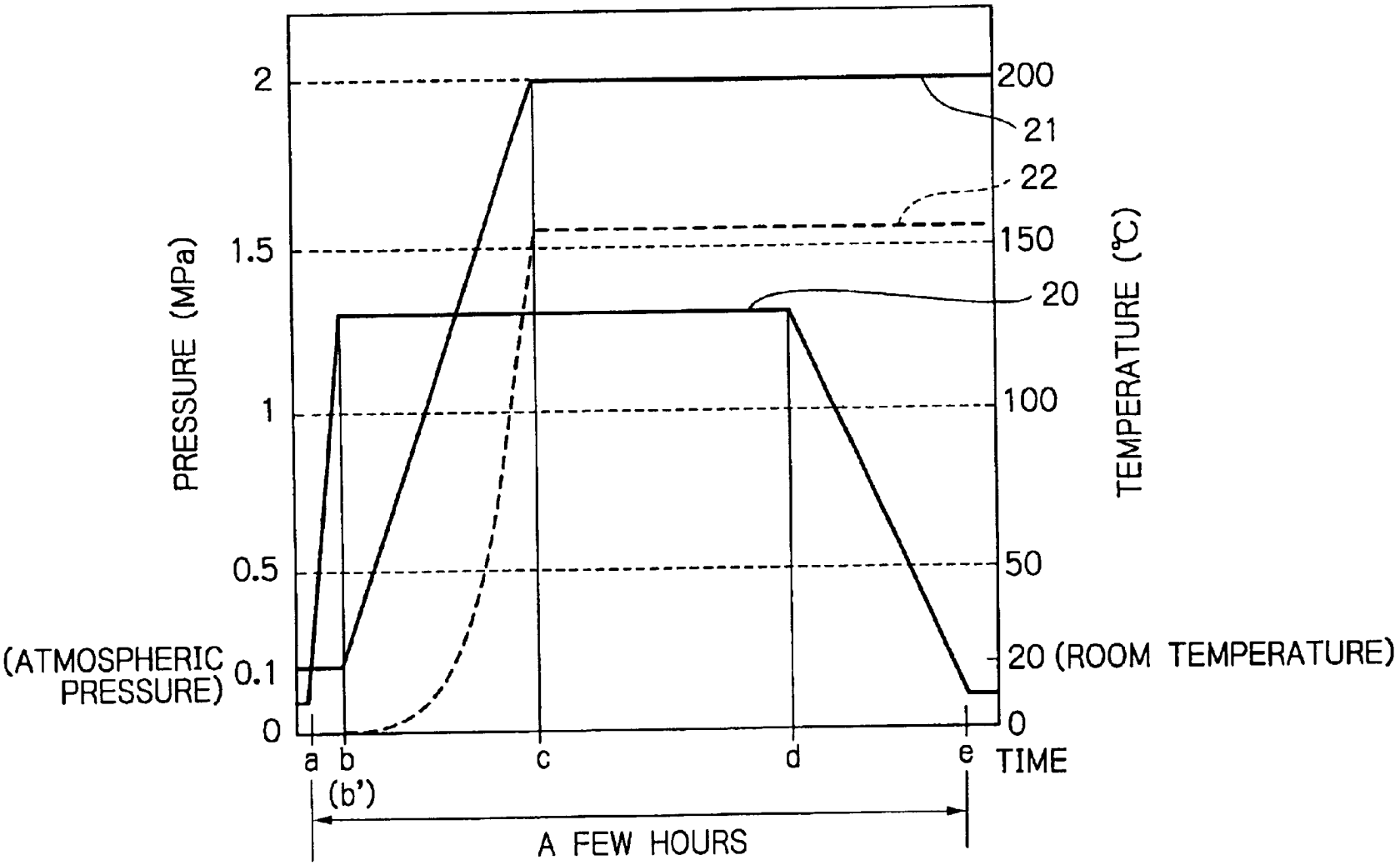
FIG. 6 is a graph representing yet another example of a drying mode in a pressure-heat drying apparatus according to the present invention.

Turning now to FIG. 6, an alternative pressure-heat drying method for a workpiece to be dried 40 in the above-described pressure-heat drying apparatus of the type equipped with no cooling section shown in FIG. 1 will be described. As shown in FIG. 1, the workpiece 40 (the ceramics with the aqueous solution of copper sulfate adhering to the entire surface thereof) is accommodated in the pressure vessel 11, and then the pressure vessel 11 is sealingly closed by the vessel lid 14. Subsequently, as shown in FIG. 6, the air is supplied from the compressor into the pressure vessel 11 through the pressure gas introduction valve 13*a* of the pressure regulating means so as to increase the pressure 20 in the pressure vessel 11 from a level of about 0.1 MPa (the atmospheric pressure) to a set pressure lower than a saturated vapor pressure of the water at a set temperature (the pressure increase process). Since the set temperature represented in FIG. 6 is 200° C., the set pressure is specified to be about 1.3 MPa, which is lower than the saturated vapor pressure of the water at this set temperature (about 1.6 MPa). Also in this case, the time period between the starting point "a" of pressure increase and the goal point "b" up to the set pressure value is specified as the pressure increase process time.

In the next step, the external heater 12*a* and the internal heater 12*b* of the temperature regulating means are activated to increase the temperature 21 in the pressure vessel 11 from a level of about 20° C. (the room temperature) to a set temperature of 200° C. and thereby evaporate a certain amount of water induced by a differential pressure between a saturated vapor pressure in the pressure vessel 11 and the set pressure in the pressure vessel 11 so as to allow the copper sulfate to be uniformly deposited onto the workpiece 40 (the temperature increase, evaporation and deposition process). During increasing the temperature 21 in the pressure vessel 11 from the level of about 20° C. (the room temperature) to the set temperature of 200° C., the fan 16 is rotationally driven to generate an air flow 45 within the pressure vessel 11, which can help the temperature in the pressure vessel 11 to be regulated efficiently by the external heater 12*a* and the internal heater 12*b*. Further, the amount of water evaporation can be controlled by controlling the temperature increase rate in this temperature increase, evaporation and deposition process.

Further, since the set pressure is about 1.3 MPa, the water starts to evaporate just at a time when the saturated vapor pressure of the water exceeds the value of about 1.3 MPa. That is, when the temperature 21 in the pressure vessel 11 reaches the temperature level of about 192° C., the water starts to evaporate and accordingly the copper sulfate begins to be deposited uniformly onto the workpiece 40. This deposition may be completed during the temperature increase process or may be performed continuously also during the pressure and temperature maintenance process, which will be described later. Also in this case, a time period from the starting point "b'" of temperature increase to the goal point "c" up to the set temperature is specified to be the temperature increase process time.

Subsequently, the above-discussed pressure and temperature maintaining means is activated to maintain the set pressure and the set temperature in the pressure vessel 11 to be constant (the pressure and temperature maintenance process). The evaporation of the water would have been almost completed in this process, and thereby the copper sulfate (the solute) could have been fully deposited over the workpiece 40. It is to be noted that a time period between the goal point "C" up to the set temperature and the starting point "d" of pressure reduction is specified to be the pressure and temperature maintenance process time.

Then, the air in the pressure vessel is exhausted through the gas exhaust valve 13*b* serving as the pressure reducing means to reduce the pressure 20 in the pressure vessel 11 from the level of about 1.3 MPa (the set pressure) to the level of about 0.1 MPa (the atmospheric pressure) (the pressure reduction process). It is to be noted that a time period from the starting point "d" of pressure reduction to the goal point "e" of pressure reduction is specified to be the pressure reduction process time. After the completion of this pressure reduction process, it is confirmed that the pressure within the pressure vessel 11 has been reduced down to the atmospheric pressure, and the workpiece 40 with the copper sulfate uniformly deposited thereon is cooled and then taken out of the pressure vessel 11.

Since the time period from the starting point "a" of pressure increase to the goal point "e" of pressure reduction counts as a few hours, in this method also, such a workpiece to be dried 40 that has been coated with the aqueous solution of copper sulfate adhering onto the entire surface thereof can be dried in a dramatically short time as compared to the prior art method.

An alternative pressure-heat drying method for the workpiece 40 in the above-discussed pressure-heat drying apparatus 1 of the type equipped with the cooling section, which is shown in FIG. 2, will now be described with reference to the graph of FIG. 7. In this graph, a solid line designated by the reference numeral 20 indicates a pressure in the pressure vessel 11, a solid line designated by the reference numeral 21 indicates a temperature in the pressure vessel 11, a broken line designated by the reference numeral 22 indicates a saturated vapor pressure of the water contained in an aqueous solution of copper sulfate at the temperature in the pressure vessel, a double broken line designated by reference numeral 23 indicates a temperature of the cooling section and a broken line designated by reference numeral 24 indicates a saturated vapor pressure at the temperature of the cooling section, each shown as a function of the time.

As shown in FIG. 2, a workpiece to be dried 40 (ceramics with the aqueous solution of copper sulfate adhering onto the entire surface thereof) is accommodated within the pressure-vessel 11 of the pressure-heat drying apparatus 1 and then the pressure vessel 11 is sealingly closed by the vessel lid 14. Subsequently, as shown in FIG. 7, the air is supplied from the compressor into the pressure vessel 11 through the pressure gas introduction valve 13*a* of the pressure regulating means so as to increase a pressure 20 in the pressure vessel 11 from a level of about 0.1 MPa (the atmospheric pressure) to a set pressure higher than a saturated vapor pressure 22 of the water at a set temperature (the pressure increase process). This set pressure may be set to be within the range of 0.5–5.0 MPa, and since the set temperature shown in FIG. 7 is 200° C., the set pressure is specified to be about 1.7 MPa higher than the saturated vapor pressure of the water at this set temperature (about 1.6 MPa). In this case also, a time period from a starting point "a" of pressure increase to a goal point "b" up to the set pressure value is specified to be the pressure increase process time.

Then, the external heater 12*a* together with the internal heater 12*b* of the temperature regulating means are activated to increase a temperature 21 in the pressure vessel 11 from a level of about 20° C. (the room temperature) to the set temperature of 200° C. thereby evaporating a certain amount of water induced by a differential pressure between a saturated vapor pressure at the temperature of the cooling section in the pressure vessel 11 and the set pressure in the pressure vessel 11 to form a condensation thereof in said cooling section so as to allow the copper sulfate to be uniformly deposited onto said workpiece to be dried (the temperature increase, condensation and deposition process). During increasing the temperature 21 in the pressure vessel 11 from the level of about 20° C. (the room temperature) to the set temperature of 200° C., the fan 16 is rotationally driven to generate an air flow 45 within the pressure vessel 11, which can help the temperature in the pressure vessel 11 to be regulated efficiently by the external heater 12*a* and the internal heater 12*b*. In this process, the amount of water to be condensed on this cooling section can be controlled by controlling the temperature increase rate in this temperature increase, condensation and deposition process.

Figure 7:
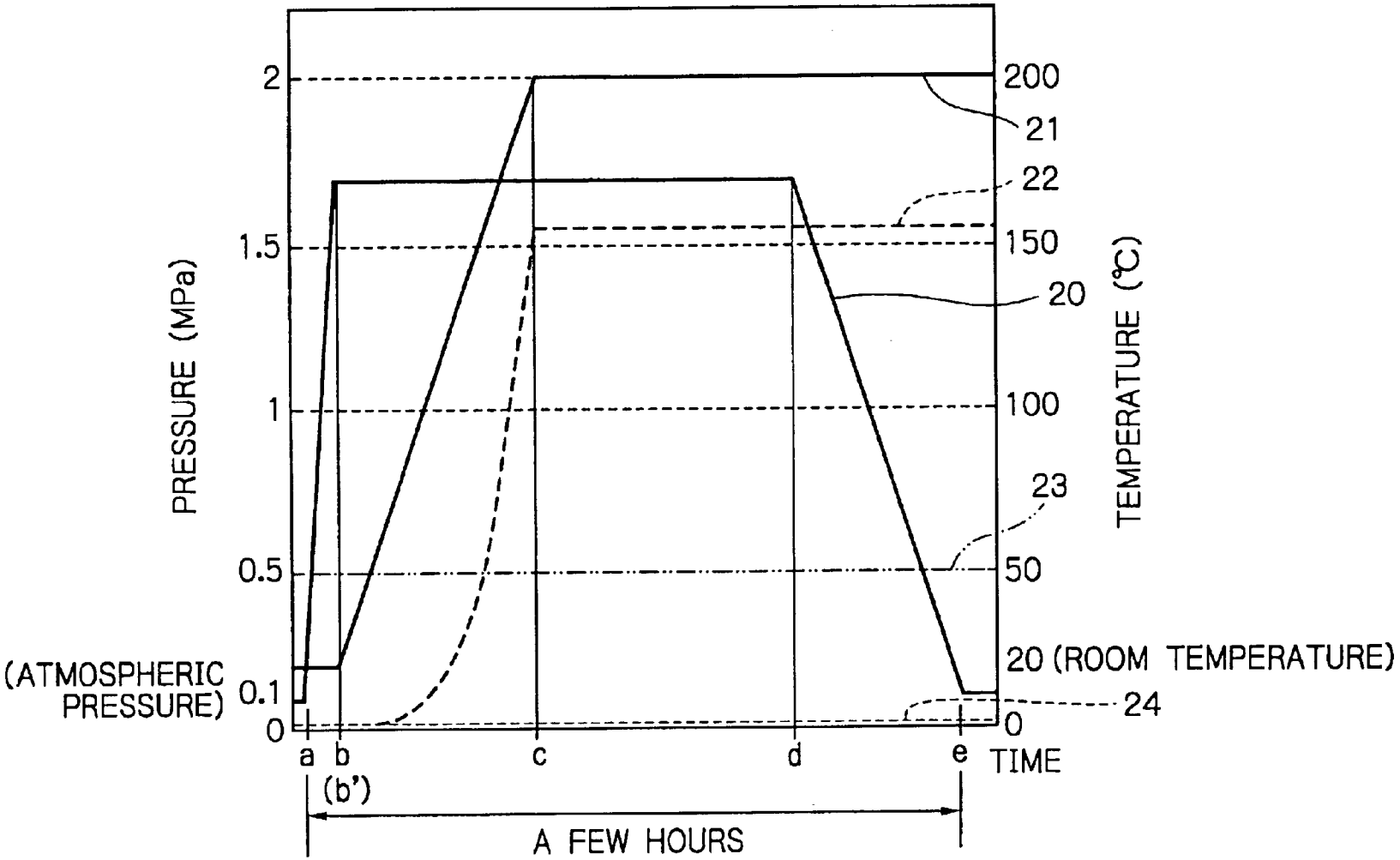
FIG. 7 is a graph representing yet still another example of a drying mode in a pressure-heat drying apparatus according to the present invention.
Figure 8:
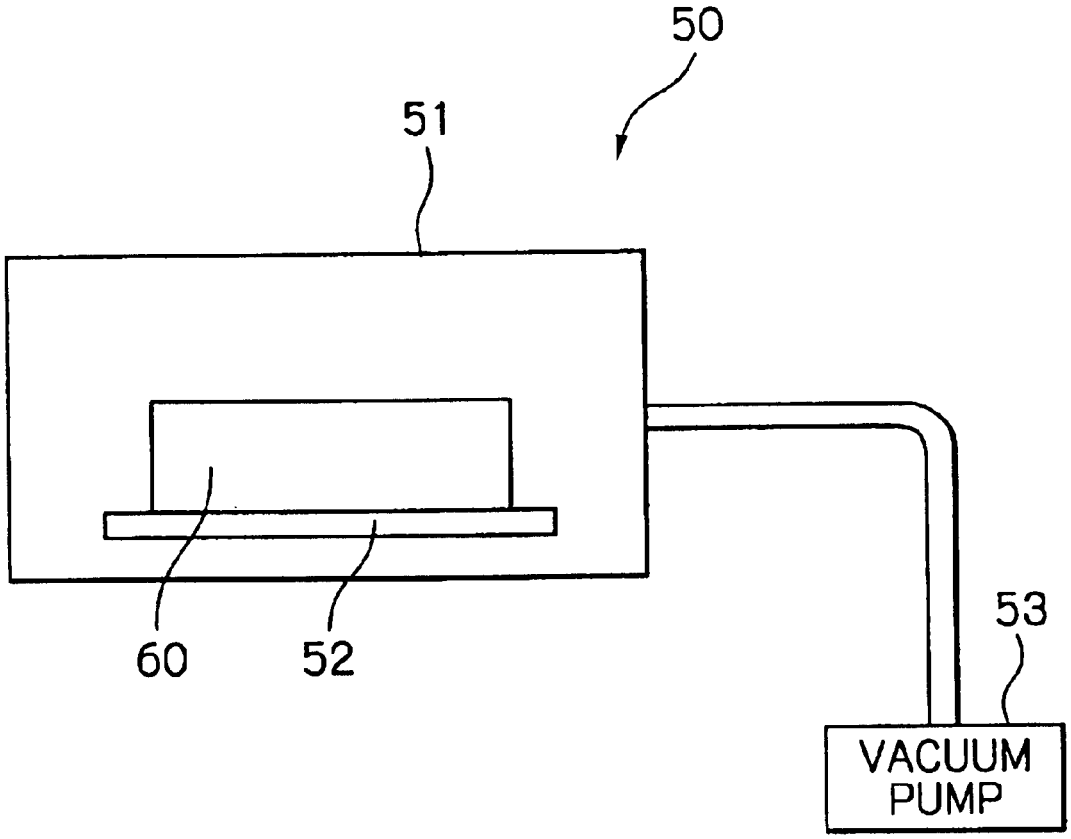
FIG. 8 is a general schematic view of a drying apparatus.

When the temperature 21 in the pressure vessel 11 is increased in the above-described manner, the water therein is evaporated by a certain amount induced by a differential pressure between a saturated vapor pressure at the temperature of the cooling section in the pressure vessel 11 and the set pressure in the pressure vessel 11 and then is formed into the condensation in the cooling section with the aid of the low temperature of the cooling section since the temperature 23 of the cooling section is maintained to be constant at a lower level (of about 50° C. in the example shown in FIG. 7). This water of condensation may be drained through a drain valve 65 as needed. By repeating this cycle of evaporation, condensation and drainage of the water, the copper sulfate can be progressively deposited uniformly over the workpiece 40. This deposition may be completed during the temperature increase, condensation and deposition process or may be performed continuously also during the pressure and temperature maintenance process, as will be described later. In this case, a time period between the starting point "b'" of temperature increase and the goal point "c" up to the set temperature is specified to be the temperature increase, condensation and deposition process time.

Subsequently, said pressure and temperature maintaining means is activated to maintain the set pressure and the set temperature in the pressure vessel 11 to be constant (the pressure and temperature maintenance process). The evaporation of the water would have been completed during this process, and thereby the copper sulfate (the solute) could have been fully and uniformly deposited over the workpiece 40. It is to be noted that a time period between the goal point "c" up to the set temperature and the starting point "d" of pressure reduction is specified to be the pressure and temperature maintenance process time.

Subsequently, the air in the pressure vessel 11 is exhausted through the gas exhaust valve 13*b* serving as the pressure reducing means so as to reduce the pressure 20 in the pressure vessel 11 from the level of about 1.7 MPa (the set pressure) to the pressure level of about 0.1 MPa (the atmospheric pressure) (the pressure reduction process). It is to be noted that a time period from the starting point "d" of pressure reduction to the goal point "e" of pressure reduction is specified to be the pressure reduction process time. After the completion of this pressure reduction process, it is confirmed that the pressure in the pressure vessel 11 has been reduced to atmospheric pressure, and the workpiece 40 with the copper sulfate deposited uniformly thereon is cooled and then taken out of the pressure vessel 11.

Since the time period between the starting point "a" of pressure increase and the goal point "e" of pressure reduction counts as a few hours, in this method also, such a workpiece to be dried 40 that has been coated with the aqueous solution of copper sulfate adhering onto an entire surface thereof can be dried in a dramatically short time as compared to that of the prior art.

According to the present invention, since the pressure process has been employed, the catalytic material and so on can be deposited uniformly onto a workpiece to be dried yet in a dramatically short time as compared to the prior art method.

The entire disclosure of Japanese Patent Application No.2002-025164 filed on Feb. 1, 2002, including specification, claims, drawings, and summary is incorporated herein by reference in their entirety.

What is claimed is:

1. A pressure-heat drying method for drying a workpiece to be dried in a pressure vessel, said workpiece coated with a solution containing a solute dissolved in a solvent adhering thereto, said method comprising:

a pressure increase process for increasing a pressure in said pressure vessel to a set pressure higher than a saturated vapor pressure of said solvent at a set temperature;

a temperature increase process for increasing a temperature in said pressure vessel to said set temperature under a condition where an evaporation of said solvent is suppressed with the aid of said set pressure which has been achieved through said pressure increase process;

a pressure and temperature maintenance process for maintaining said set pressure and said set temperature in said pressure vessel at constant levels, respectively; and a pressure reduction and deposition process for reducing said set pressure to a level lower than the saturated vapor pressure at said set temperature and thereby stimulating a rapid evaporation of said solvent so as to allow said solute to be uniformly deposited onto said workpiece.

2. A pressure-heat drying method in accordance with claim 1, in which an amount of evaporation of said solvent is controlled by controlling a pressure reduction rate in said pressure reduction and deposition process.

3. A pressure-heat drying method for drying a workpiece to be dried in a pressure vessel, said workpiece coated with a solution containing a solute dissolved in a solvent adhering thereto, said method comprising:

a pressure increase process for increasing a pressure in said pressure vessel to a set pressure higher than a saturated vapor pressure for said solvent at a set temperature;

a temperature increase, condensation and deposition process for increasing a temperature in said pressure vessel to said set temperature and thereby evaporating a certain amount of said solvent induced by a differential pressure between a saturated vapor pressure at a temperature of a cooling section in said pressure vessel and said set pressure in said pressure vessel to form a condensation thereof in said cooling section so as to allow said solute to be uniformly deposited onto said workpiece;

a pressure and temperature maintenance process for maintaining said set pressure and said set temperature in said pressure vessel at constant levels, respectively; and a pressure reduction process for reducing said set pressure.

4. A pressure-heat drying method in accordance with claim 3, in which an amount of said solvent to form the condensation in said cooling section is controlled by controlling a temperature increase rate in said temperature increase, condensation and deposition process.

5. A pressure-heat drying method for drying a workpiece to be dried in a pressure vessel, said workpiece coated with a solution containing a solute dissolved in a solvent adhering thereto, said method comprising:

a pressure increase process for increasing a pressure in said pressure vessel to a set pressure lower than a saturated vapor pressure for said solvent at a set temperature;

a temperature increase, evaporation and deposition process for increasing a temperature in said pressure vessel to said set temperature, and thereby evaporating a certain amount of said solvent induced by a differential pressure between a saturated vapor pressure in said pressure vessel and said set pressure in said pressure vessel so as to allow said solute to be uniformly deposited onto said workpiece;

a pressure and temperature maintenance process for maintaining said set pressure and said set temperature in said pressure vessel at constant levels, respectively; and a pressure reduction process for reducing said set pressure.

6. A pressure-heat drying method in accordance with claim 5, in which an amount of evaporation of said solvent is controlled by controlling a temperature increase rate in said temperature increase, evaporation and deposition process.

* * * * *